United States Patent [19]

Borsani

[11] Patent Number: 5,048,780

[45] Date of Patent: Sep. 17, 1991

[54] PEDESTAL WITH RADIAL ARMS FOR CHAIRS, FURNITURE AND THE LIKE, OF VARIABLE DIMENSIONS

[75] Inventor: Paolo Borsani, Milan, Italy

[73] Assignee: Tecno S.p.A. Mibili e Forniture per Arredamento, Milan, Italy

[21] Appl. No.: 491,326

[22] Filed: Mar. 9, 1990

[30] Foreign Application Priority Data

Mar. 10, 1989 [IT] Italy ..... 20715/89[U]

[51] Int. Cl.[5] ..... F16M 11/20

[52] U.S. Cl. ..... 248/188.7; 248/345.1

[58] Field of Search ..... 248/188.7, 188.8, 188.9, 248/345.1

[56] References Cited

U.S. PATENT DOCUMENTS

| | | | |
|---|---|---|---|
| 2,992,803 | 7/1961 | Good | 248/188.7 |
| 3,179,340 | 3/1973 | Norton | 248/188.7 X |
| 3,617,023 | 11/1971 | Schneiderman | 248/188.7 |
| 4,262,871 | 4/1981 | Kolk et al. | 248/188.1 |
| 4,365,839 | 12/1982 | Strassle | 248/188.7 X |
| 4,534,533 | 8/1985 | Doerner | 248/345.1 |
| 4,598,892 | 7/1986 | Franckowiak et al. | 248/188.7 X |
| 4,699,344 | 10/1987 | Vaughan | 248/188.7 X |
| 4,744,538 | 5/1988 | Hofman | 248/188.7 X |
| 4,911,391 | 3/1990 | Ellis | 248/188.7 |

*Primary Examiner*—Ramon O. Ramirez

*Attorney, Agent, or Firm*—Herbert Dubno

[57] ABSTRACT

A pedestal with radial arms for chairs, items of furniture and the like comprising a metal core formed of a cylindrical boss to which may be attached a column capable of securing and supporting the seat or item of furniture, this boss having attached thereto one or a plurality of tubular metal arms projecting radially therefrom, with a boss cover member which can be inserted on the core having a central member and one or a plurality of radial branches corresponding to the arms of the metal core which are open at the base and extend over part of the length of the said arms, together with for each arm of the metal core a covering sheath provided with means of attachment to the end of the arm which can be inserted in a longitudinal direction on the corresponding branch of the boss cover member to a length depending on the extent of the arm.

5 Claims, 3 Drawing Sheets

PEDESTAL WITH RADIAL ARMS FOR CHAIRS, FURNITURE AND THE LIKE, OF VARIABLE DIMENSIONS

FIELD OF THE INVENTION

This invention relates to a pedestal with radial arms for chairs, furniture and the like, having variable dimensions.

BACKGROUND OF THE INVENTION

For items of furniture of various kinds, and in particular for chairs and office chairs and the like, pedestals having several, usually five, radial arms surrounding a central column which is connected at the top to the seat are widely used.

The radial arms of the pedestal extend radially for a sufficient distance to confer the required stability upon the chair.

Chairs or office chairs of different sizes and characteristics, for example fixed seats or seats with articulated joints, require pedestals of different diameters in order to achieve equivalent stability characteristics.

Pedestals of this kind are also used with the same or a different number of radial arms for items of furniture of various kinds, such as for example tables, occasional tables and the like, and individually appropriate pedestal dimensions are required for these purposes.

A convenient form of constructing such pedestals provides for an internal core of metal which is intended to support the applied load and a cover constructed of molded plastic material providing the core with the desired aesthetic characteristics.

The cores of such pedestals may readily and economically be constructed from metal components which are cut to length and joined together by welding, while the cover, which is destined to be the visible part of the pedestal, has to be moulded to the intended size in a single piece or in several pieces.

Thus in order to be able to construct pedestals of different dimensions it is necessary to have several different molds resulting in with an appreciable increase in costs.

Also the fit between the welded core and the moulded portions may not be satisfactory, and may give rise to difficulties in assembly.

OBJECTS OF THE INVENTION

It is, therefore, the object of the present invention to provide a pedestal structure avoiding disadvantages of the known structures, which is economical to construct and can be used to provide different sizes without the provision of several molds.

Still another object of the invention is to provide a pedestal structure which can be easily assembled and can be used for furniture having variable dimensions.

SUMMARY OF THE INVENTION

These results are achieved by this invention, which provides a pedestal with radial arms for seats, furniture and the like, comprising a metal core mounted on a cylindrical boss which can be connected to a column capable of attachment to and of supporting the seat or item of furniture, the boss being connected to one or to a plurality of tubular metal arms projecting radially therefrom and associated with a boss-covering member which can be inserted onto the core and has a central member and one or a plurality of radial branches corresponding to the arms of the metal core, the branches are open beneath and extend over part of the length of the said arms and are connected together with a covering sheath for each arm of the metal core provided with means for attachment at the end of the arm. The sheath can be inserted in the longitudinal direction into the corresponding branch of the boss-covering member to a length dependent on the extension of the arm.

The sheath has a centering plug which can be inserted into a tubular arm and has a through hole which, when assembled, can be aligned with a corresponding hole placed close to the free end of the tubular arm, and a fixing these aligned holes.

In greater detail, the covering sheath consists of a member of plastics material having an upside-down substantially U cross-section. The centering plug can be inserted into the tubular arm at the free end of the arm and at the other end a tie member connecting the lower edges which is capable of coming into contact with the corresponding lower edges of the branches of the boss cover is provided, one or a plurality of transverse ribs being provided within the sheath so as to center the sheath about the boss in conjunction with the tie.

The covering sheath has a window in its upper wall corresponding to the centering plug which can be shut by means of a corresponding cover so that the plug itself can be easily molded.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
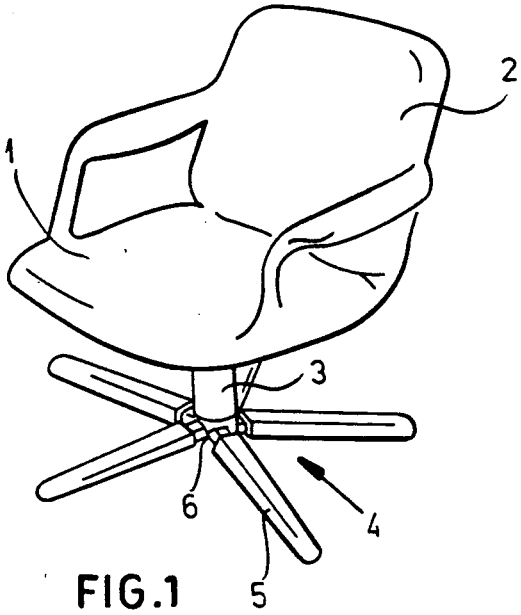
FIG. 1 is a perspective view of a chair with a pedestal according to the invention.

As shown in FIG. 1, the chair or office chair has a seat 1 and a back 2 supported by a column 3, which may be of the telescopic type, attached at the lower end to a pedestal 4.

Pedestal 4 commonly consists of a plurality of arms 5, normally five, projecting radially from a central boss 6 which is attached to column 3.

Figure 2:
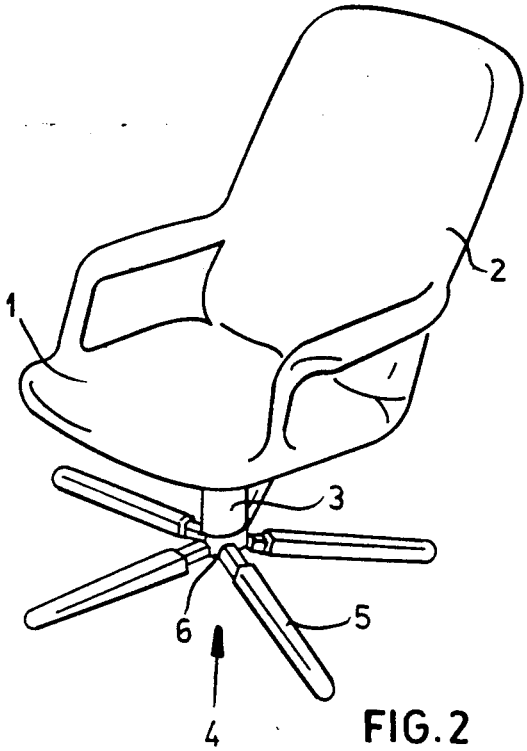
FIG. 2 is a perspective view of a chair with a pedestal having arms of greater diameter.

The extension of arms 5, i.e. the maximum diameter of the pedestal, is determined by the required size of the base. For example, as illustrated in FIG. 2, for a larger seat with a higher back, pedestal 4 will preferably be of a larger diameter than the one of a chair shown in FIG. 1, i.e. will have longer arms 5.

Figure 3:
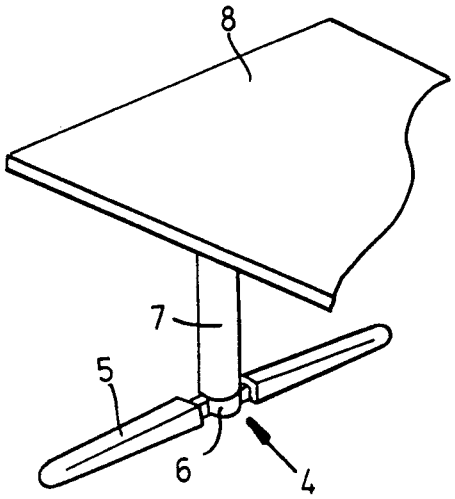
FIG. 3 shows a portion of the end of a table with a pedestal according to the invention.
Figure 4:
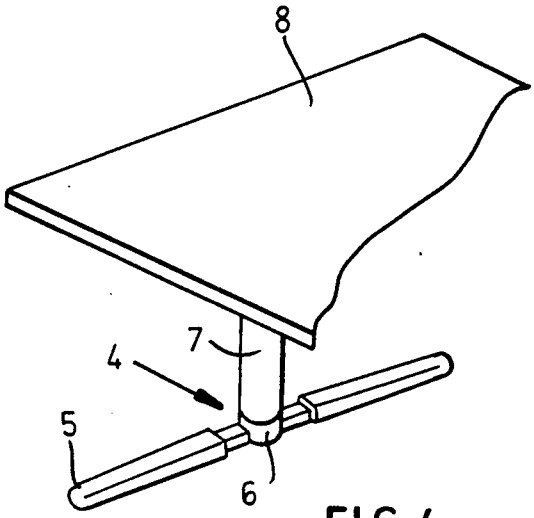
FIG. 4 shows the end portion of a table similar to that in FIG. 3, but with a top of larger size and a wider pedestal.

Similarly, circular tables having a single pedestal with several radial arms of the most appropriate diameter may be constructed, or, as illustrated in FIG. 3, rectangular or any other shapes of tables which have a pedestal 4 supporting a column 7 of the fixed type to which the top 8 is connected may also be constructed. FIGS. 3 and 4 illustrate pedestal 4 having two opposite arms 5, and in the case of tables having a larger top 8, as illustrated in FIG. 4, arms 5 may be of greater length than arms shown in FIG. 3.

Figure 5:
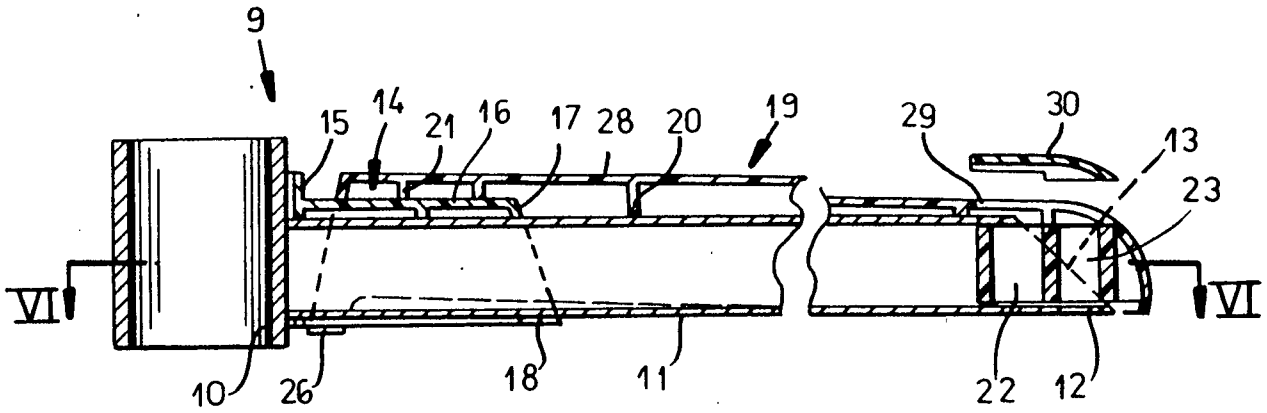
FIG. 5 is an axial section of the pedestal according to the invention along the plane V—V in FIG. 6.
Figure 6:
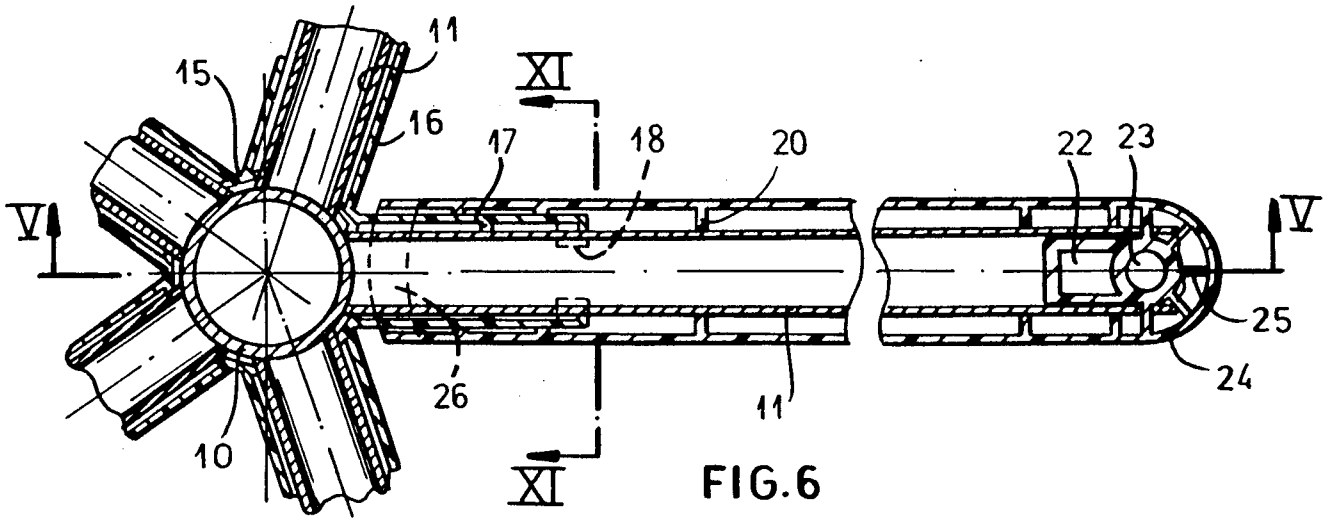
FIG. 6 is a top view of the pedestal along the plane VI—VI in FIG. 5.

In order to achieve the required size of pedestal, for example, as illustrated in FIG. 5 a central metal core 9 suitably is constructed of tubular steel members cut to a desired length and welded together and comprises a central cylindrical boss 10 to which column 3 or 7 illustrated in FIGS. 1 and 3 is connected and to which tubular arms 11 are attached is provided.

Arms 11 are cut to a length corresponding to the desired size of the diameter of the pedestal and at their free ends in the part opposite to boss 10 have a corresponding hole 12 for the attachment of a pin bearing a supporting foot, caster or the like; the free ends of the arms are also appropriately provided with an oblique bevel 13.

In order to provide the pedestal with the desired aesthetic characteristics a boss cover 14 of plastic material or the like capable of being fitted onto boss 10 by movement in an axial direction is provided.

Boss cover 14 has a substantially cylindrical central portion 15 from which project a plurality of radial branches 16 corresponding in number and position to the arms 11.

Each of branches 16 consists of a member having a substantially U-shape which is open at the base and which can enclose the sides and top of the respective arm 11. Two or more ribs 17 extending inwardly towards the arms ensure correct centering of branches 16 around arms 11 and thus contribute in an appropriate fit all boss cover 14 on core 9 of the pedestal.

Figure 11:
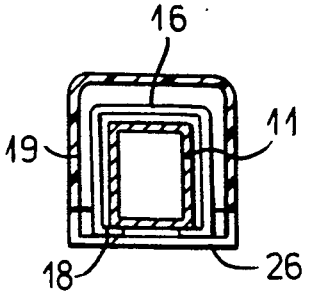
FIG. 11 is a cross-sectional view along the plane XI—XI in FIG. 6.

Two fins 18 placed at the end of each branch 16 capable of surrounding the lower face of the corresponding arm for a short distance, as better shown in FIG. 11, as a result of the elastic deformability of the material covering the boss, ensure that the boss cover is firmly mounted on core 9.

Covering sheaths 19 are then placed over branches 14 and arms 11 and these too are suitably constructed of plastics material and completely cover the visible surfaces of core 9 so as to provide the desired aesthetic appearance.

Sheaths 19 consist of longitudinally extended members with a cross-section substantially in the form of an upside-down U, provided with internal ribs 20, 21 to enter into contact with arms 11 of core 9 and branches 16 of the boss cover respectively, centering the sheaths on these members. At its outer end each sheath also has a centering plug 22 which can be inserted within corresponding arm 11 with slight elastic deformation; a hole 23 in plug 22 is aligned with hole 12 in such a way that a pin passed through both holes prevents any possibility of the sheath coming off the arm.

The pin which is to be inserted in holes 12, 23 is conveniently constructed as a pin supporting and securing a foot supporting the pedestal on the ground, a caster or the like, in accordance with aesthetic or practical requirements; hole 23 may of suitable shape and diameter corresponding to this pin so that for example the said pin may be secured by interference or by means of a thread.

The pin, or the supporting member borne by it, is however designed to rest against arm 11, directly transmitting the applied load from the metal arm to the supporting member without the load acting on the members of the cover.

Plug 22 is made integral with the end wall of sheath 24 through a plurality of ribs 25.

The size of sheath 19 is fixed. It can however be adapted to different arm lengths of core 9 by telescopically varying the amount of overlap with branches 16 of the boss cover.

The end of sheath 19 close to the boss cover is provided with a tie 26 which joins together the bottom edges of the sheath itself, this tie being supported against the lower edge of branches 16, thus preventing the sheath from slipping upwards at these points, the sheath therefore becoming completely integral with the metal core.

Figure 7:
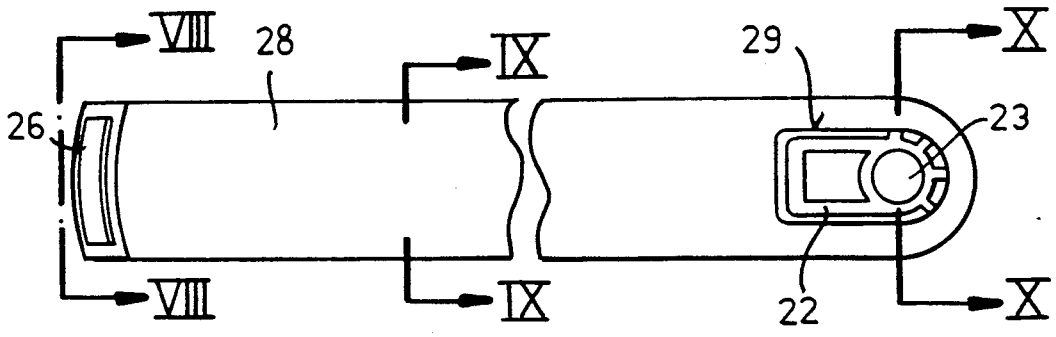
FIG. 7 is a top view of the arm covered with the sheath according to the invention.
Figure 8:
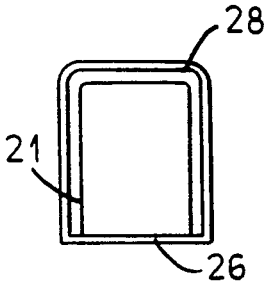
FIG. 8 is a cross-sectional view along the plane VIII—VIII in FIG. 7.
Figure 9:
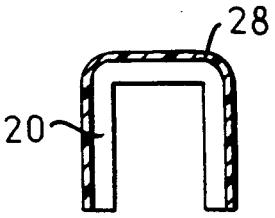
FIG. 9 is a cross-sectional view along the plane IX—IX in FIG. 7.
Figure 10:
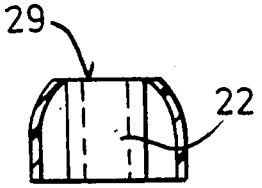
FIG. 10 is a cross-sectional view along the plane X—X in FIG. 7.

Sheath 19 may be constructed of molded plastics material using a mould of simple shape, avoiding undercut portions. For this purpose the end of the sheath facing the boss has a sufficient inclination, as illustrated in FIG. 7, projecting to project beyond the end of the upper wall 28 of the sheath; at the other end, corresponding to plug 22, wall 28 has a window 29 through which the upper surface of the plug can be molded.

A cover 30 shown in FIG. 5 can be clipped into window 29, thereby closing the window and restoring continuity to the surface.

It is therefore possible to obtain pedestals of different dimensions using the same molded members and without having to provide several molds of different dimensions, it only being necessary to construct core 9 to the desired size, and this, being constructed of welded metal components, may be constructed to be of any desired size without having an adverse effect on costs.

The lengths of the arms may also be different from each other in a given pedestal, for example for aesthetic reasons, only different dimensions of the arms 11 of the metal core being necessary for this.

Pedestals for various purposes and having different numbers of arms may be constructed in a similar way; for example, pedestals with several radial arms combined with a fixed loadbearing column may be constructed for the central support of round or square-shaped tables, or pedestals may be constructed with only two opposing arms as illustrated in FIGS. 3, 4, or with a single arm to form a support for tables with an extended e.g. rectangular top using two identical pedestals. It is possible in every case to construct arms of different lengths using the same cover members.

I claim:

1. A pedestal assembly for supporting an item of furniture, said pedestal assembly comprising:

a cylindrical boss formed with a metal core centered on a vertical axis;

at least one horizontal tubular metal arm formed with an upper segment and a lower segment and provided with a first end and a free end, said tubular arm extending radially longitudinally from said axis and being operatively connected by said first end with said boss;

a boss cover member formed with a central member inserted on said metal core and with at least one branch extending radially longitudinally from said axis along said arm and terminating at a distance from said free end of said arm, said branch being formed with a pair of edges spaced apart and extending along said lower segment; and a covering sheath mounted on said free end of said arm and extending longitudinally toward said first end, said sheath covering said upper segment of said arm and being formed with:

an elongated plastic member having substantially an inverted U-shaped cross section, said member being provided with an inner surface facing said arm and being formed with a first end and a second end, a centering plug formed on said second end of said member and mounted in said free end of said arm, a tie member provided on said first end of said member and having a portion thereof bridging said edges of said boss cover member, and at least one rib formed on said inner surface of said member and extending inwardly toward said arm, said sheath being pulled along said arm toward said fist end of the arm and overlapping said boss cover member, so that said upper segment of the arm is covered completely by said sheath and said boss, said sheath being centered on said arm and on said boss by said tie member and said rib.

2. The pedestal assembly defined in claim 1 wherein said free end of said arm is provided with a hole extending between said inner and outer segments, said hole receiving said plug upon pulling said sheath longitudinally.

3. The pedestal assembly defined in claim 2 wherein said plug of said sheath is aligned with said hole formed with an outer edge and receiving a pin member supporting said assembly on the ground but not projecting beyond said upper segment.

4. The pedestal assembly defined in claim 3, further comprises a window provided in said sheath, said pin member traversing said window and being covered by a cover having portions thereof complementing said outer edge, so that said upper segment is continuously covered.

5. A pedestal assembly for supporting an item of furniture, said pedestal assembly comprising:

a boss formed with a metal core centered on an axis;

at least one elongated horizontal arm extended radially from said axis and having a first end and a free end, said arm being operatively connected by said first end with said boss and being provided with an upper segment;

an elongated boss cover member formed with a central member inserted on said metal core and with at least one branch extending radially from said axis along said upper segment of said arm and terminating at a distance from said free end of said arm; and a longitudinal covering sheath mounted on said free end and having an end portion, said sheath being pulled toward said first end of the arm, so that said end portion of the sheath overlaps said cover member, said end portion of the sheath being provided with a tie member adapted to embrace said lower segment of said arm and said boss cover member close to said first end of the arm, so that said sheath and said boss cover member are positioned on the arm and completely cover said upper segment thereof.

* * * * *

UNITED STATES PATENT AND TRADEMARK OFFICE

CERTIFICATE OF CORRECTION

PATENT NO. : 5 048 780

DATED : 17 September 1991

INVENTOR(S) : Paolo BORSANI

It is certified that error appears in the above-identified patent and that said Letters Patent is hereby corrected as shown below:

Title Page:

Item [73] should read:

-- Tecno S.p.A. Mobili ... -- .

Signed and Sealed this

Twenty-third Day of February, 1993

*Attest:*

STEPHEN G. KUNIN

*Attesting Officer*

*Acting Commissioner of Patents and Trademarks*